United States Patent [19]

Credner et al.

[11] 4,198,239

[45] Apr. 15, 1980

[54] COLOR PHOTOGRAPHIC MATERIALS CONTAINING AN ANTISTAIN AGENT

[75] Inventors: Hans-Heinrich Credner, Hohenschaeftlarn; Rigobert Otto, Leverkusen; Karl-Wilhelm Schranz, Odenthal-Hahnenberg, all of Fed. Rep. of Germany

[73] Assignee: AGFA-Gevaert, A.G., Leverkusen, Fed. Rep. of Germany

[21] Appl. No.: 829,229

[22] Filed: Aug. 31, 1977

[30] Foreign Application Priority Data

Sep. 4, 1976 [DE] Fed. Rep. of Germany ..... 2639930

[51] Int. Cl.[2] ..... G03C 1/06; G03C 7/00

[52] U.S. Cl. ..... 430/566; 430/372; 430/471; 430/551

[58] Field of Search ..... 96/100, 56, 95

[56] References Cited

U.S. PATENT DOCUMENTS

| | | | |
|---|---|---|---|
| 2,403,721 | 7/1946 | Jelley et al. | 96/56 |
| 2,675,314 | 4/1954 | Vittum | 96/56 |
| 2,701,197 | 1/1955 | Thirtle et al. | 96/56 |
| 3,935,016 | 1/1976 | Nishimura et al. | 96/95 |

*Primary Examiner*—J. Travis Brown

*Attorney, Agent, or Firm*—Connolly & Hutz

[57] ABSTRACT

An improvement in the prevention color-fog and staining in color-photographic materials is obtained by the inclusion of acylamino substituted hydroquinones derivatives. The compounds can easily be synthesized do not crystalize from their dispersions and are not oxidized to colored by-products during development.

2 Claims, No Drawings

COLOR PHOTOGRAPHIC MATERIALS CONTAINING AN ANTISTAIN AGENT

This invention relates to an antistain agent for colour photographic recording materials and to a process for the stabilization of colour photographic materials by the addition of a suitable antistain agent which is capable of reducing the formation of colour fogs.

Coloured images are known to be produced by developing exposed silver halide emulsions in the presence of the usual colour developers so that, in addition to the silver image, a coloured image is produced by reaction of the oxidized colour developer with colour couplers which are present at the same time. These colour couplers may be added in known manner either to the emulsion layers or to adjacent layers or to the developer solution. The colour developers normally used for the production of coloured images are, in particular, p-phenylene diamines, or their substituted derivatives.

Coloured images produced by the usual processes frequently have colour fogs or discolourations. Formation of a colour fog is due to the fact that the developer compounds are to a certain extent oxidized by the atmosphere and that the oxidized developer couples with the colour coupler in those parts of the photographic recording material in which no silver image was originally produced. This unwanted oxidation of the developer may be due to the action of air or it may be due to the presence of additives in the emulsion, and it may occur equally in the different layers or it may be more pronounced in one or more layers so that the effect produced may be either a uniform colour fog or a discolouration of the photographic material.

This effect is mainly observed in recording materials which contain couplers in the light-sensitive layers, and particularly if the developer solutions have not been sufficiently stabilized against oxidation. The colour fog or the discolouration cannot be prevented by the methods normally used for stabilizing the silver emulsions.

In U.S. Pat. Nos. 2,403,721 and 2,701,197 and in German Offenlegungsschrift No. 2,110,521 it has been proposed to use alkyl and dialkyl hydroquinone derivatives as antistain agents for colour photographic materials.

These compounds have, however, various disadvantages, including the fact that many of them can only be prepared by complicated processes comprising 2 to 4 stages and the fact that some of them are not sufficiently resistant to diffusion so that when employed in multilayered colour photographic recording materials they are liable to migrate between the individual layers to give rise to undesirable side effects. Furthermore, they are liable to crystallise before or after their application or to have a deleterious effect on the physical or chemical properties of the layers, one particularly disadvantageous effect of some alkyl hydroquinones being that they give rise to coloured by-products by an oxidation reaction either during application of the layer containing them or during development. The discolouration of the photographic material produced by these by-products is particularly disturbing in colour photographic copying materials.

It is also known that an improvement in colour reproduction can be achieved by arranging, between the light-sensitive silver halide emulsion layer and a layer containing the colour couplers, an intermediate layer of a composition such that it suppresses the diffusion of oxidation products of the developer into the layer which contains colour couplers. To achieve this effect, the substances incorporated in this intermediate layer include compounds which react with the developer oxidation products to form colourless compounds. These so-called white couplers only reduce the colour fog to an extent which is insufficient for practical purposes.

It is therefore an object of the present invention to provide new antistain agents which do not have the disadvantages described above, which can easily be synthesised which do not crystallise from their dispersions in aqueous, hydrophilic colloid coating compounds either before or during or after their application and which are not oxidized to coloured by-products during development.

It has now been found that hydroquinone derivatives of the general formula

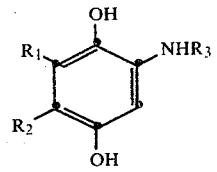

in which $R_1$ and $R_2$ which may be the same or different represent hydrogen, an alkyl chain preferably having up to 3 carbon atoms, halogen in particular chlorine or a sulpho or carboxyl group, $R_3$ represents an acyl group which is derived from an aliphatic carboxylic acid for example from palmitic or stearic acid, but in particular from aroxy substituted, preferably phenoxy substituted, carboxylic acids, such as di-t-pentyl-phenoxy-acetic acid, 4-chloro-2-tetradecylphenoxyacetic acid or dodecyloxyphenoxypropionic acid; an aliphatic or aromatic chlorocarbonic acid ester or a substituted or unsubstituted carbamic acid, clearly fulfil the stated requirements.

Hydroquinone derivatives which carry an $\alpha$-, $\beta$- or $\gamma$-aroxy substituted, in particular a phenoxy substituted, aliphatic acylamino group in the 2-position are particularly suitable. This phenoxy group may be substituted once or more than once, for example with alkyl or alkoxy groups, in particular those having up to 18 carbon atoms, with halogen, in particular chlorine, hydroxyl, cycloalkyl, in particular cyclopentyl or cyclohexyl, sulpho or carboxyl. Furthermore, the phenoxy group may contain a condensed carbocyclic ring which may be partially hydrogenated.

The aliphatic acylamino group preferably contains up to 5 carbon atoms.

The following compounds have proved to be particularly suitable:

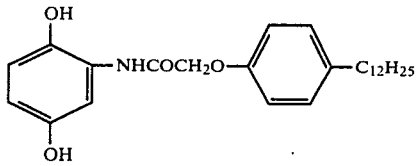
(1)
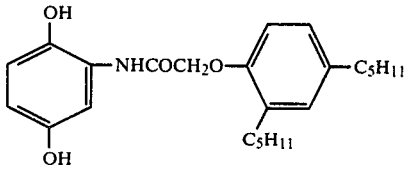
(2)
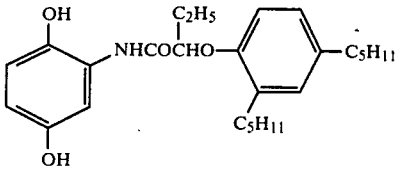
(3)
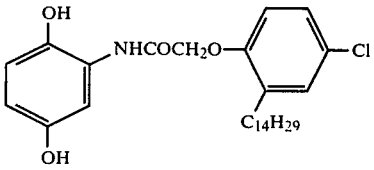
(4)
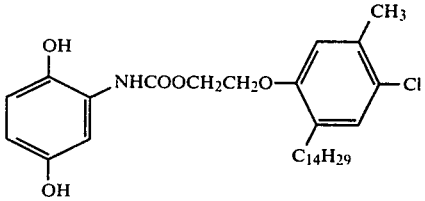
(5)
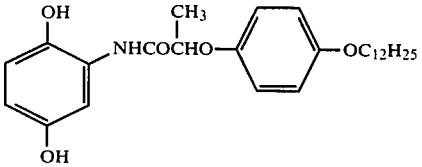
(6)
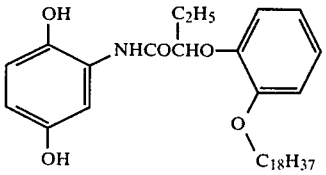
(7)
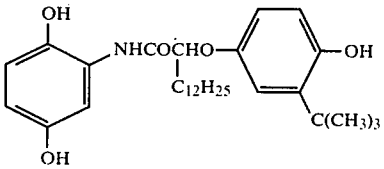
(8)
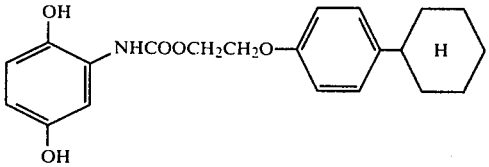
(9)

-continued (10)

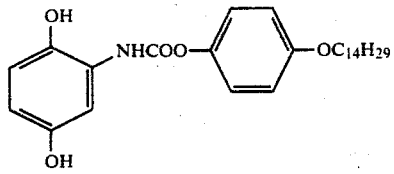

(11)

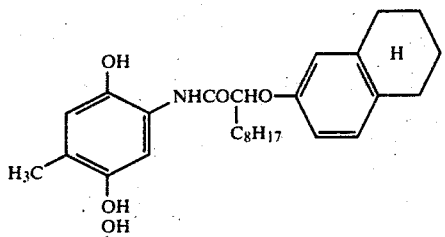

(12)

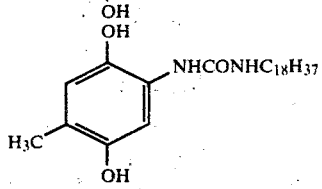

(13)

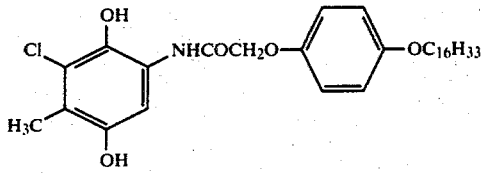

(14)

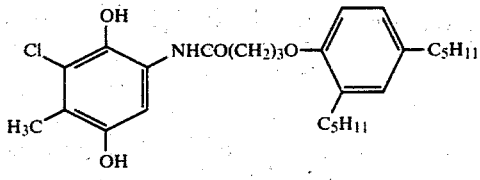

(15)

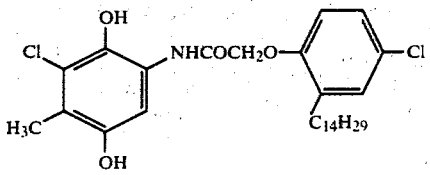

(16)

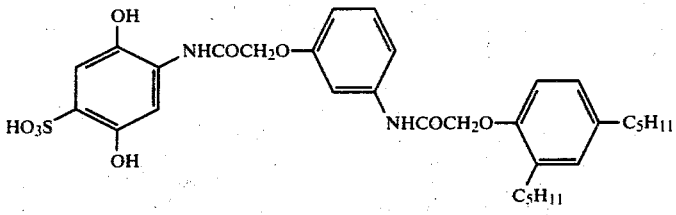

The antistain agents used according to the invention may be prepared quite simply by reacting aminohydroquinone hydrochloride with fatty acid chlorides. Aminohydroquinone hydrochloride is synthesised in known manner from nitrohydroquinone, for example according to the method of Henrich, Ber. 54, 2506.

Compound 3:

α-2,4-Di-tert.-pentyl-phenoxybutyrylaminohydroquinone 16.1 g (0.1 mol) of aminohydroquinone hydrochloride are dissolved in 150 ml of acetonitrile and 24.2 g (0.2 mol) of dimethylaniline.

33.85 g (0.1 mol) of 2,4-di-t-pentyl-phenoxybutyryl chloride are added dropwise at room temperature.

The reaction mixture is stirred for one hour and then poured on a mixture of ice water and hydrochloric acid and the product is extracted with ethyl acetate. After removal of the ethyl acetate by distillation, the residue is crystallised with ligroin. Recrystallisation from nitromethane.

Melting point: 157° to 159° C.

Yield: 33 g≙76% of the theory.

Compound 4:
2-Tetradecyl-4-chlorophenoxy-acetylaminohydroquinone:

The compound of formula 4 is obtained from 2-tetradecyl-4-chlorophenoxyacetyl chloride by a similar method to that of Example 1.

Melting point: 118° to 121° C.

The other compounds may be prepared in a similar manner.

Another possible method of synthesis consists of starting with known cyan components such as 2-α-di-tert.-pentylphenoxy-n-butyramino-4,6-dichloro-5-methylphenol and hydrogenating these to the corresponding hydroquinone derivatives via the benzoquinone stage according to German Offenlegungsschrift No. 2,509,408.

The compounds according to the invention are particularly suitable for reducing the formation of a colour fog or of discolouration in colour photographic materials.

The compounds according to the invention may be used to advantage wherever it appears suitable to inactivate unwanted oxidation products of the colour developer.

The antistain agents according to the invention convert the oxidzed form of any primary aromatic amine colour developer used for colour development, into the developer compound or into a form which will not couple with the colour coupler.

The compounds according to the invention may be used in a layer of any multilayered colour photographic material. For example, they may be added to one or more of the light-sensitive layers and/or to protective layers or intermediate layers applied on or between light-sensitive layers. They may be used in colour photographic materials in which colour couplers are incorporated in the light-sensitive emulsion layer and they may also be used in multi-layered colour photographic materials which do not contain any colour coupler. The colour photographic materials may either be recording materials, copying materials or reversal materials. The compounds may also be incorporated in a diffusion resistant form in the separating layers of multilayered colour photographic materials, thereby contributing to better colour separation so that migration of oxidized colour developer from one layer to another is suppressed.

When added as diffusion resistant compounds to colour couplers, the compounds according to the invention serve to control the gradation of the silver halide layers. When not resistant to diffusion, the compounds according to the invention may be used in light-sensitive layers and in adjacent layers or they may be added to photographic processing baths such as the short stop baths, fixing baths or hardener baths or they may be used as aqueous solutions on their own before or after the photographic process or between separate stages thereof to prevent the formation of colour fog.

As already mentioned above, the compounds may be introduced into the photographic material at any time before chromogenic development of the silver image or they may be added to a bath after development, for example in order to suppress the formation of colour fog due to coupling of the colour couplers with residual colour developers which have not been removed.

The compounds according to the invention may be used at various concentrations depending on the light-sensitive silver halide emulsion used in any individual case, the concentration of silver halide in the emulsion layers and the required concentration of the dye which is to be formed. When used in the photographic material, e.g. in the silver halide emulsion layers, these compounds are advantageously added in quantities of from 0.004 to 0.04, mol per mol of silver, preferably 0.008 mol per mol of silver. If the compounds are introduced into the colour photographic materials in the form of a solution, for example in a processing solution, they are suitably employed at concentrations of between about 100 mg and 5 g per liter of solution, preferably between 500 mg and 2 g per liter of solution. The optimum concentration depends on the particular photographic recording material in which the antistain agent is to be used, and it can easily be determined by known methods. When the antistain agents are used in auxiliary and intermediate layers, they are preferably added in quantities of from 50 to 500 mg, more preferably from 150 to 200 mg per $m^2$.

The compounds according to the invention are preferably added as solutions to the auxiliary layers or to the light-sensitive layer. The solvent used may be water, a lower aliphatic alcohol, tetrahydrofuran, acetone, ethyl acetate, dimethylformamide or mixtures thereof. A preferred method of introducing the compounds according to the invention consists of dissolving them together with the colour coupler and then introducing the combined solution into the light-sensitive silver halide layer. Introduction of the compounds according to the invention into the light-sensitive emulsion is preferably carried out after chemical ripening or before the completely prepared emulsion is cast.

The colour photographic materials used according to the present invention may be any of the usual silver halide emulsions. The silver halides contained in them may be silver chloride, silver bromide, or mixtures thereof, and may have a small silver iodide content of up to 10 mol percent. The binder used for the photographic layers is preferably gelatine but this may be partly or completely replaced by other natural or synthetic binders. Suitable natural binders include e.g. alginic acid and its derivatives such as its salts, esters or amides; cellulose derivatives such as carboxymethylcellulose, alkyl celluloses such as hydroxyethyl cellulose; starch or its derivatives such as ethers or esters, or carageenates. The following are suitable synthetic binders: Polyvinyl alcohol, partially saponified polyvinyl acetate and polyvinyl pyrrolidone.

The emulsions may also be chemically sensitized, for example, by the addition of sulphur compounds such as allyl isothiocyanate, allyl thiourea and sodium thiosulphate during chemical ripening. Reducing agents such as the tin compounds described in Belgain Patent Specifications Nos. 493,464 and 568,687; polyamines such as diethylene triamine and aminomethyl sulphinic acid derivatives such as those mentioned in Belgain Patent Specification No. 547,323 may also be used as chemical sensitizers.

Noble metals such as gold, platinum, palladium, iridium, ruthenium or rhodium and compounds of these metals are also suitable as chemical sensitizers. This method of chemical sensitization has been described in the article by R. Koslowsky, Z. Wiss. Phot. 46, 65–72 (1951).

The emulsions may also be sensitized with polyalkylene oxide derivatives, for example with a polyethylene oxide having a molecular weight of between 1000 and 20,000 with condensation products of alkylene oxides and aliphatic alcohols, glycols, cyclic dehydration products of hexitols, alkyl substituted phenols, aliphatic carboxylic acids, aliphatic amines, aliphatic diamines and amides. The condensation products have a molecular weight of at least 700, preferably more than 1000. These sensitizers may, of course, be combined to produce special effects, as described in Belgian Patent Specification No. 537,278 and in British Patent Specification No. 727,982.

The emulsions may also be optically sensitized, for example with the usual polymethine dyes such as neutrocyanines, basic or acid carbocyanines, rhodacyanines, hemicyanines, styryl dyes and oxonoles. These sensitizers have been described in the work by F. M. Hamer, "The Cyanine Dyes and Related Compounds" (Interscience Publishers).

The emulsions may contain the known stabilizers, e.g. homopolar compounds or salts of mercury containing aromatic or heterocyclic rings, such as mercapto tetrazoles, simple mercury salts, sulphonium mercury double salts and other mercury compounds. Azaindenes are also suitable stabilizers, particularly tetra- or penta-azaindenes and especially those which are substituted with hydroxyl or amino groups. These compounds have been described in the article by Birr, Z. wiss. Phot. 47, 2–58 (1952). Other suitable stabilizers include heterocyclic mercapto compounds such as phenyl mercapto tetrazole, quaternary benzothiazole derivatives and benzotriazole.

The emulsions may be hardened in the usual manner, for example with formaldehyde or halogen substituted aldehydes which carry a carboxyl group such as mucobromic acid, diketones, methane sulphonic acid esters, dialdehydes, compounds containing vinyl sulphone groups, halogenated triazines such as monohydroxydichlorotriazine or the hardeners described in German Offenlegungsschriften Nos. 2,225,230; 2,317,677; 2,408,814; 2,439,551 and 2,547,589.

The emulsions may also contain compounds which increase the sensitivity, plasticizers and coating auxiliaries.

As is well known, photographic materials consisting of a substrate on which light-sensitive silver halide emulsion layers sensitive to red, green and blue light are applied above one another are particularly suitable for producing coloured images. Silver images may be developed in these layers, and dyes can be produced imagewise in proportion to the developed silver images. The dyes produced are preferably cyan, magenta and yellow. It is preferred to produce dye images which are in a complementary relation to the region of the spectrum to which the silver halide emulsion layer has been sensitized.

Photographic materials which may be used according to the invention include, for example, photographic materials for taking original photographs, copying materials, reversal materials, reprotechnical films and colour photographic materials such as those used, for example in the dye diffusion process.

The substrates used for the colour photographic materials according to the invention may be any of the usual substrates such as foils of cellulose esters, polycarbonates, in particular those based on bis-hydroxyphenyl alkanes, polyesters, in particular polyethylene terephthalate, and paper, for example baryta paper supports or paper coated with polyolefines, e.g. with polyethylene or polypropylene, which have been exposed to corona treatment to improve adherence of the photographic layers to them. Glass may, of course, also be used as the substrate. Colour developers are used for producing the dye images in the photographic materials according to the invention, for example the usual aromatic compounds based on paraphenylenediamine containing at least one primary amino group. Suitable colour developers include, for example, N,N-dimethyl-p-phenylene diamine; N,N-diethyl-p-phenylenediamine; monomethyl-p-phenylenediamine; 2-amino-5-diethylaminotoluene; N-butyl N-ω-sulphobutyl-p-phenylenediamine and 2-amino-5-(N-ethyl-N-β-methanesulphonamidoethylamino)-toluene. Other suitable colour developers have been described, for example, in J. Amer. Chem. Soc. 73, 3000 to 3025 (1951).

The materials according to the invention may contain colour couplers, masking couplers and white couplers of various constitutions incorporated in a diffusion resistant form in hydrophilic layers of binder, that is to say they may, for example, be incorporated in a light-sensitive silver halide emulsion layer or they may be incorporated in a light-insensitive layer of binder adjacent thereto. If the colour couplers are water-soluble, they may be added as alkali metal salts in aqueous or aqueous alcoholic solution. Water-insoluble couplers may be dispersed in known manner, for example with the aid of ethyl acetate and a wetting agent, and incorporated with the emulsion in the form of a dispersion. In that case, if the coupler tends to recrystallise in the dispersion, an oil former such as dibutylphthalate may be added. Couplers which are not diffusion resistant may also be added. These may be incorporated in the hydrophilic layers with the aid of mordants or they may be incorporated with the aid of a colour developer solution by a classical method of the photographic reversal process, as described in U.S. Pat. No. 2,252,718. Compounds derived from phenol or α-naphthol are used as cyan couplers, compounds derived from 2-pyrazolinone-5 or indazolone as magenta couplers and compounds derived from β-ketocarboxylic acid derivatives, for example benzoyl acetanilide, are used as yellow couplers. The couplers may be unsubstituted in the coupling position or they may carry in the coupling position a substituent which is split off in the reaction with the developer oxidation products, for example to release a development inhibitor. Suitable colour couplers have been described, for example, in the survey entitled "Farbkuppler" by W. Pelz in Mitteilungen aus den Forschungslaboratorien der Agfa-Leverkusen-München, Vol. 3, pg. 111.

EXAMPLE 1

The following dispersions or solutions are added to 1 kg of a red-sensitive photographic silver iodobromide emulsion which has been prepared from 145 g of silver nitrate and contains a proportion of silver to gelatine of 0.6:

(a) 42 g of the cyan component 1-hydroxy-N-[δ-(2'-cyclopentyl-4'-t-butylphenoxy)-n-butyl]naphthamide dissolved in 130 ml of ethyl acetate and 20 g of tricresyl phosphate are dispersed in known manner in 170 ml of a 10% aqueous gelatine solution.

(b) 4 g of the red azo mask 1-hydroxy-4-(6'sulpho-2'-naphthylazo)-N-(2'-methyl-octadecylamino-5'-sulphophenyl)-2-naphthamide are dissolved to form a 5% aqueous alkaline solution.

(c) 2 g of the DIR coupler, 1-hydroxy-4-(2'-phenyl-tetrazolemercapto)-N-(2'-tetradecyloxyphenyl)-2-naphthamide are dispersed as described under (a) above.

The emulsion containing the additives (a), (b) and (c) is then cast on a cellulose triacetate substrate to form a layer of about 4.5μ in thickness and dried. A strip of film was exposed through a step wedge and then subjected to colour negative development at 25° C. in known manner, using a colour developer of the following composition:

Developer D 4 g of 2-amino-5-(N-ethyl-N-hydroxyethylamino)-toluene sulphate monohydrate,
2.5 g of sodium hexametaphosphate,
4 g of anhydrous sodium sulphite,
2 g of hydroxylamine hydrochloride,
100 g of potassium carbonate,
1 g of potassium bromide,
water up to 1000 ml.

A second colour wedge is prepared by adding dispersion d to the reaction mixture indicated above.

(d) 3 g of compound 3 are dissolved in 10 ml of ethyl acetate and 1.5 g of tricresyl phosphate and dispersed in known manner in 12 ml of a 10% aqueous gelatine solution. This emulsion is then cast as described above, dried, exposed and developed. The two cyan colour wedges obtained differ from each other in that the one first prepared has a colour fog of 0.3 (optical density) while the one containing antioxidant according to the invention has a colour fog of only 0.2.

EXAMPLE 2

A multilayered material is prepared with the cyan casting emulsion described in Example 1. The red sensitive emulsion layer is first covered with a 1 to 2μ thick layer of gelatine containing 8 g/m$^2$ of white coupler No. 4 described in German Auslegeschrift No. 1,123,913. A green-sensitive layer prepared as follows is then applied:

The following dispersions are added to 1 kg of a silver iodobromide emulsion which has been prepared from 135 g of silver nitrate with a silver/gelatine ratio of 0.6:

(a) 32 g of the magenta component 1-(2',4',6'-trichlorophenyl)-3-(2'',4''-dipentylphenoxybutyroyl-3'-aminophenyl)amino-pyrazolone in 100 ml of ethyl acetate and 30 g of tricresyl phosphate are dispersed in known manner in 250 ml of a 10% aqueous gelatine solution.

(b) 2 g of the yellow masking dye, 1-(1'',1''-difluoro-2'',2''-fluoro-chloroethyloxy-2-phenyl)-3-(4'-hexadecyl-sulphonylphenyl)-amino-4-(4'-phenoxy-ethoxy-phenyl)-azo-pyrazolone-5 are dispersed either in a similar manner to (a) or together with the magenta component described under (a).

(c) 3.5 g of the DIR coupler, 1-(2''-α-methyltridecyl-4-chloro-phenoxyacetyl-4'-aminophenyl)-3-pyrrolidino-4-(2'-phenyl-tetraazolemercapto)-pyrazolone-5 are dispersed either in a similar manner to (a) or together with the magenta component described in (a).

Over this layer is cast another green-sensitive layer which, however, has a higher sensitivity than the layer underneath it. This upper layer is prepared as follows:

The following dispersions are added to 1 kg of a silver iodobromide emulsion which has been prepared from 155 g of silver nitrate in a ratio of silver to gelatine of 0.4:

(d) 10 g of the magenta component under (a) is dissolved and dispersed as described therein.

(e) 4 g of the masking dye under (b) is dispersed in the manner described therein.

A Yellow filter layer according to Carey and Lee is cast above this last mentioned layer.

On top of these layers is cast a blue-sensitive silver iodobromide emulsion layer which has been prepared from 80 g of silver nitrate in a silver/gelatine ratio of 1.4 and to which the following dispersions have been added:

(f) 70 g of the yellow component, α-piraloyl-α-5'-carbomethoxytriazole-2-hexadecyloxy-5-methylsulphonamido acetanilide are dissolved in 200 ml of ethyl acetate and dispersed in 280 ml of 10% aqueous gelatine solution.

(g) 4 g of the white coupler, 1-(4'-methylsulphonylphenyl)-3-(2''-α-methyltridecyl-4''-chloro-5''-methylphenoxyethoxycarbonyl-amino)-4-methylpyrazolone-5 are dispersed either in a similar manner to (f) or together with the yellow coupler described under (f).

To this multilayered casting is added a protective gelatine layer 1 to 2μ in thickness.

A strip of film of this multilayered material was exposed through a step wedge and developed with the colour development bath described in Example 1. A second colour wedge is prepared by adding dispersion (h) described below to the above described green-sensitive layer which contains additives (a), (b) and (c):

(h) 1 g of compound 3 is dissolved in 5 ml of ethyl acetate and 0.5 g of tricresyl phosphate and dispersed in known manner in 12 ml of a 10% aqueous gelatine solution.

In addition, a dispersion prepared in the same way as described under (h) but containing 1.5 g of compound 3 is added to the other green-sensitive emulsion which contains additives (d) and (e).

Furthermore, a dispersion prepared as described under (h) but containing 3 g of compound 3 are added to the blue sensitive emulsion which contains additives (f) and (g).

A multilayered casting prepared with these additives is exposed and developed in the same way as described above. Grey wedges having the following fog values are obtained in both cases:

| Added Compound 3 | Magenta fog | Yellow fog |
|---|---|---|
| Without | 1.15 | 0.85 |
| With | 1.01 | 0.66 |

This demonstrates the effectiveness of the compound according to the invention.

EXAMPLE 3

A multilayered material prepared in the same way as described in Example 2 but with the addition of compound 4 in place of compound 3 in the same layers as in Example 2 and in the same quantities is subjected to a series of development times:

| Development time in min. | 2 | 3 | 4 | 5 |
|---|---|---|---|---|
| Magenta fog without additive | 0.57 | 0.95 | 1.25 | 1.6 |
| Magenta fog with compound 4 | 0.55 | 0.77 | 1.05 | 1.3 |

-continued

| Development time in min. | 2 | 3 | 4 | 5 |
|---|---|---|---|---|
| Yellow fog without additive | 0.55 | 0.65 | 0.96 | 1.28 |
| Yellow fog with compound 4 | 0.53 | 0.60 | 0.8 | 1.10 |

It can be seen from the Table that the fog reducing effect sets in clearly after only 3 minutes and is maintained thereafter.

EXAMPLE 4

Compound 4 which is to be used according to the invention is added to the yellow filter layer of the multilayered material of Example 2 in quantities of 4 g (4 g/liter of filter yellow) in the manner already described. A multilayered material containing no additives and a multilayered material containing, in the yellow filter layer, 4 g of 2,5-dioctylhydroquinone, which is already known in the literature and has been described in U.S. Pat. No. 2,403,721, are used for comparison. The following fog values were obtained:

| Film sample | Magenta fog | Yellow fog |
|---|---|---|
| without additive | 0.74 | 0.90 |
| with compound 4 | 0.66 | 0.78 |
| with dioctylhydroquinone | 0.70 | 0.73 |

The superior effect of the compound according to the invention in reducing fog is clear from a comparison of the above fog values.

EXAMPLE 5

Another multilayered material according to Example 2 containing no antistain agent is compared with a material which, like that of Example 4, contains 4 g of compound 1 per liter of filter yellow in the casting solution for yellow filter. A material as described in Example 4, containing 2,5-dioctylhydroquinone in the yellow filter layer, was developed in the same manner as comparison material. The following fog values were obtained:

| Film sample | Magenta fog | Yellow fog |
|---|---|---|
| without additive | 0.81 | 1.02 |
| with compound 1 | 0.68 | 0.80 |
| with dioctylhydroquinone | 0.75 | 0.88 |

This shows clearly the fog reducing effect of the compound according to the invention.

We claim:

1. Light-sensitive color photographic material containing at least one silver halide emulsion layer, characterized by containing an antistain agent of the following formula

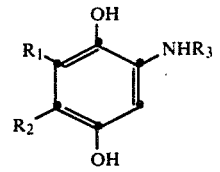

in which $R_1$ and $R_2$ represent hydrogen, alkyl with up to 3 carbon atoms, halogen, sulpho or carboxyl and $R_3$ represents an acetyl group substituted with a phenoxy group which may itself be substituted.

2. Material according to claim 1, characterised in that colour couplers are incorporated in a diffusion resistant form in the light-sensitive silver halide emulsion layer and the antistain agents are contained in this layer or an adjacent layer.

* * * * *